United States Patent [19]

Peterson et al.

[11] Patent Number: 4,939,495

[45] Date of Patent: Jul. 3, 1990

[54] CIRCUIT BREAKER WITH AUXILIARY STATUS INDICATING SWITCH

[75] Inventors: Robert W. Peterson, Attleboro, Mass.; Jacques Chammas, Warwick, R.I.

[73] Assignee: Texas Instruments Incorporated, Dallas, Tex.

[21] Appl. No.: 452,865

[22] Filed: Dec. 19, 1989

[51] Int. Cl.[5] ..... H01H 71/04; H01H 73/12

[52] U.S. Cl. ..... 337/79; 335/13; 337/66; 337/74

[58] Field of Search ..... 337/79, 66, 74, 70; 335/17

[56] References Cited

U.S. PATENT DOCUMENTS 4,400,677 8/1983 Cobb, III et al. ..... 337/74

4,612,528 9/1986 Peter ..... 337/66

*Primary Examiner*—H. Broome

*Attorney, Agent, or Firm*—John A. Haug; James P. McAndrews; Melvin Sharp

[57] ABSTRACT

A circuit breaker is shown having movable contacts carried by an operating member which moves between a circuit breaker contacts closed position and a circuit breaker contacts open position. An auxiliary switch has electrically conductive, flexible contact members adapted to engage an electrically conductive bridging shaft element carried by the operating member when the operating member is in one of its two positions to provide means for indicating the status of the circuit breaker.

5 Claims, 3 Drawing Sheets

CIRCUIT BREAKER WITH AUXILIARY STATUS INDICATING SWITCH

BACKGROUND OF THE INVENTION

This invention relates generally to electrical circuit breakers and more particularly to thermally responsive circuit breakers for interrupting electrical circuits on the occurrence of predetermined conditions in the circuits.

Thermally responsive electrical circuit breakers typically interrupt electrical circuits in response to the occurrence of selected overload conditions in the circuits to protect other equipment in the circuits from damage due to overheating or overcurrent or the like. In one particular advantageous breaker shown in U.S. Pat. No. 3,361,882 commonly assigned to the assignee of the present invention, and a similar breaker shown in U.S. Pat. No. 4,400,677, also assigned to the assignee of the present invention, a control mechanism manually moves movable contacts into and out of engagement with complementary contacts to open and close a circuit and a thermally response bimetallic member is operable to open the circuit in response to the occurrence of a selected overload current in the circuit. The bimetallic member is formed of metal materials having substantial electrical resistance properties and the member is disposed in the circuit breaker so that the member is self-heated and flexes to a selected extent to trip the mechanism to open the breaker circuit when selected overload current flows in the circuit for a selected period of time. The circuit breaker is adapted to be latched in open circuit position until manually reset after it has been manually open or has been opened in response to the occurrence of an overload current. It is also "trip free" in that the circuit breaker will open in response to the occurrence of an overload current even if the manual resetting means is manually held in the circuit closing position.

In some applications, for example when used as aircraft circuit breakers, it is desirable to provide a visual or other indication of the status of the circuit breaker. In such applications there may be provided a large number of circuit breakers so that the ability to readily discern which breakers are in the closed position and which ones are in the open position would be advantageous.

SUMMARY OF THE INVENTION

It is an object of the invention to provide a novel and improved thermally responsive electrical circuit breaker, to provide such a circuit breaker having thermally responsive bimetallic means adapted to be heated and flexed in response to the occurrence of an overload current in the breaker circuit for tripping a mechanism to open the breaker circuit, to provide such a circuit breaker adapted to provide indication of the status of the circuit breaker, whether it is in the closed position or open circuit position, and to provide such circuit breaker having a reliable and inexpensive structure.

Briefly described, the novel and improved circuit breaker of this invention comprises movable contact means, complementary stationary contact means and a control mechanism for normally holding the movable contact means in engagement with the complementary contact means in a closed circuit position. The control mechanism includes a thermally response bimetallic member having substantial electrical resistance properties which is disposed in the breaker circuit so that an overload current flowing in the circuit for a selected period of time self-heats the bimetallic member causing it to flex and trip the mechanism to open the breaker circuit in any conventional manner. The movable contact means is mounted on an electrically conductive shaft which in turn is mounted on an operating member adapted to move between upper and lower positions, the operating member being in the lower position when the movable contact means is in engagement with the complementary contact means. An auxiliary circuit includes first and second electrically conductive spring contacts which extend in parallel spaced relation into the path that the conductive shaft takes when the operating member moves between the upper and lower positions. The shaft is adapted to be in engagement with the conductive spring contacts forming a bridging element when the operating member is in its upper position with the movable contact means out of engagement with the complementary contact means and out of engagement with the conductive spring contacts when the operating member is in its lower position with the movable contact means in engagement with the complementary contact means. The spring contacts are in turn electrically coupled to connecting pins through a diode to characterize the direction of current flow in the auxiliary circuit.

DESCRIPTION OF THE DRAWINGS

Other objects, advantages and details of the novel and improved thermally responsive circuit breaker of this invention appear in the following detailed description of the preferred embodiment of the invention, the detailed description referring to the drawings in which.

DESCRIPTION OF THE PREFERRED EMBODIMENT

Figure 1:
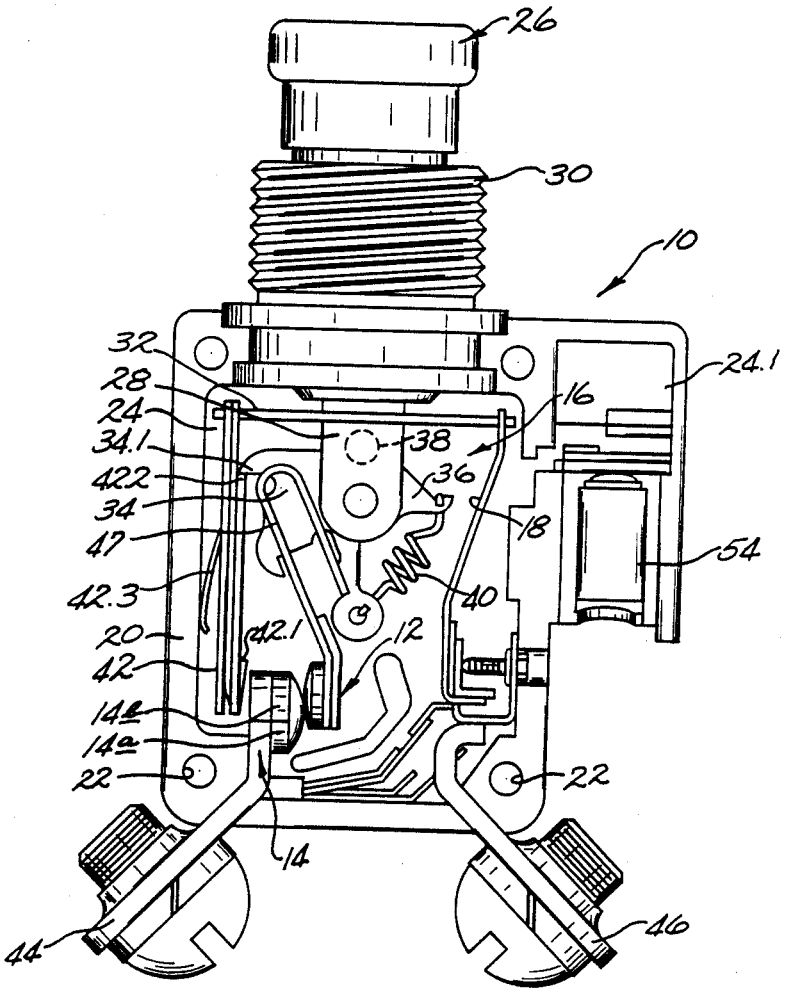
FIG. 1 is a side elevation view of a circuit breaker as shown in U.S. Pat. No. 4,400,677 with its housing modified in accordance with the present invention to accept an auxiliary switch.
Figure 2:
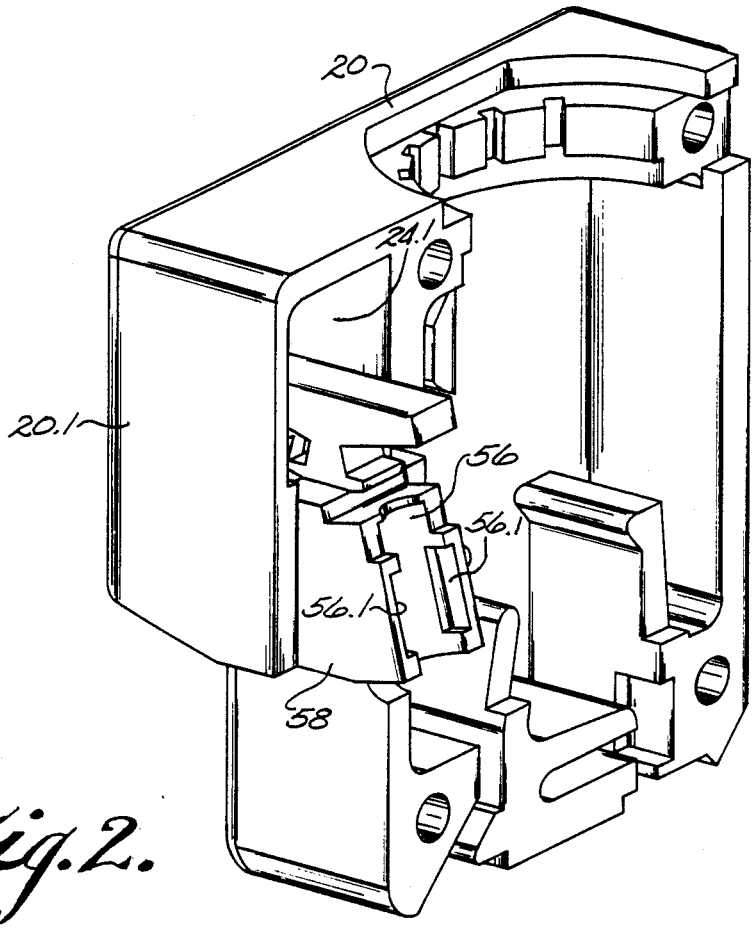
FIG. 2 is a perspective of one half of the casing or housing of the FIG. 1 breaker shown with a spacer member received between the two case halves.

Referring to the drawings, numeral 10 in FIG. 1 indicates a thermally responsive circuit breaker similar to that shown in U.S. Pat. No. 3,361,882 and 4,400,677 referenced supra, with its housing modified in accordance with the present invention. Breaker 10 is shown to include movable contact means 12, complementary stationary contact means 14 and a control mechanism 16, the control mechanism including thermally responsive bimetallic means 18. The control mechanism normally holds the movable contact means 12 in engagement with the complementary contact means 14 to close the breaker circuit. However, the thermally responsive bimetallic means 18 has substantial electrical resistance properties and is disposed in the breaker circuit where it is adapted to be self-heated and to flex to a predetermined extent in response to the flow of a selected overload current in the breaker circuit for a selected period of time. When the thermally responsive bimetallic means flexes to that extent, it is adapted to trip the mechanism 16 to move the movable contact means out of engagement with the complementary contact means to open the breaker circuit in a conventional manner. In the preferred embodiment of the circuit breaker 10 according to this invention, the control mechanism 16 is also adapted to manually move the movable contacts into and out of engagement with the complementary contacts, to releasably latch the movable contact means to open circuit position when they are moved to that position either manually or in response to the occurrence of an overload circuit, to permit the breaker circuit to be manually reset after manual opening or after normal opening in response to overload currents if the bimetallic means have cooled, to be compensated for variations in ambient temperature in its normal thermal response to the occurrence of an overload current in the breaker circuit and to be trip free.

As thus far described, the circuit breaker 10 substantially corresponds to the circuit breaker illustrated in U.S. Pats. No. 3,361,882 and 4,400,677, the disclosure of which are hereby incorporated herein by this reference. That is, the circuit breaker includes a pair of mating casing halves 20 (only one being shown in FIG. 1) which are secured together by rivets (not shown) extending through the casing apertures 22 to form an enclosure or chamber 24 therebetween, the casing halves having grooves and abutments therein for locating the various breaker components in the chamber or on the casing halves as will be understood. A push-pull button 26 and an operating member 28 are mounted in a bushing 30 which is held between the casing halves, the bushing threads serving to mount the breaker on a control panel or the like so that the push-pull button is accessible on the panel as will be understood. The operating member 28 extends into the chamber 24 and through an aperture (not shown) in a motion transfer member 32 so that the bell crank 34 and an anchor plate 36 are rotatable in a bifurcated end of the operating member on a shaft 38. A spring 40 biases the bell crank to rotate in a counterclockwise direction as viewed in FIG. 1 and a latch 42 pivotable in slot 42.1 in the casing halves has a latch end 42.2 normally engaged with a latch nose 34.1 on the bell crank. The complementary contact means 14 comprise a first complementary contact **14*a* connected to one terminal 44 and a second complementary contact 14*b* which is electrically connected to a terminal 46 through the bimetallic means 18. The movable contact means 12 are mounted on a bell crank 34 by spring means 47 and are adapted to be moved into and out of resilient, bridging engagement with two complementary contacts 44 for closing and opening the breaker circuit. The motion transfer member is movable with the bimetallic member 18 for moving latch 42 as the bimetallic member moves, and additional latch and spring means (not shown) are incorporated within the bushing 30**.

As the structure thus far described is shown in the patents referenced supra, it is not further described herein and it will be understood that, if the push-pull button 26 is manually depressed when a breaker circuit is open and when the bimetallic member is cold, the bimetallic member 18, the motion transfer member 32, and the latch 42 are in the position as shown in FIG. 1, the latch being biased by a spring part 42.3 to pivot to the right in casing slot 42.1 as viewed in FIG. 1. Accordingly, the operating member 28 moves the bell crank 34 downwardly to engage the nose 34.1 with the latch end 42.2 and to rotate the bell crank clockwise against the bias of the spring 40 to engage the movable contact means 12 with the complementary contact means 14 to close the breaker circuit between the terminals 44 and 46. The releasable latch and spring means (not shown) within the bushing 30 resiliently hold the bell crank in the position shown while the breaker contacts are in the illustrated closed circuit position. In that arrangement, the breaker circuit extends from the terminal 44 through the contacts 12 are 14 and via the bimetallic member 18 to the terminal 46. Pulling on the button 26 is effective to release the latch means (not shown) within the bushing 30 so that the bell crank 34 rotates counterclockwise to disengage the movable contacts 12 rom the complementary contacts 14 to open the breaker circuit and to move the push button 26 outwardly from the bushing 30.

If an overload current occurs in the breaker circuit, that current flows through the thermally responsive member 18 which is formed of metal materials having substantial electrical resistance properties in the normal manner of thermally responsive bimetallic members. As a result, the member tends to be self-heated and to flex (to the left as viewed in FIG. 1) in response to such self-heating. The bimetallic member is proportioned in conventional manner so that, when a selected overload current continues for a period of time, the bimetallic member flexes sufficiently to move the transfer member 32 to unlatch end 42.2 from the bell crank nose 34.1. When that occurs, the bell crank rotates counterclockwise under the bias of the spring 40 moving the contacts 12 to open circuit position and releasing the resilient pressure on the releasable latch means (not shown) within the bushing 30, whereby the spring means (not shown) in the bushing 30 move the push-pull button 26 and the operating member 28 upwardly to their open circuit position. The latch end 42.2 is mounted on the latch 42 by thermally responsive means which compensates for changes in ambient temperature so that the above described opening of the breaker circuit occurs after the occurrence of the selected overload current for the selected period of time even under varying ambient temperature conditions.

Figure 3:
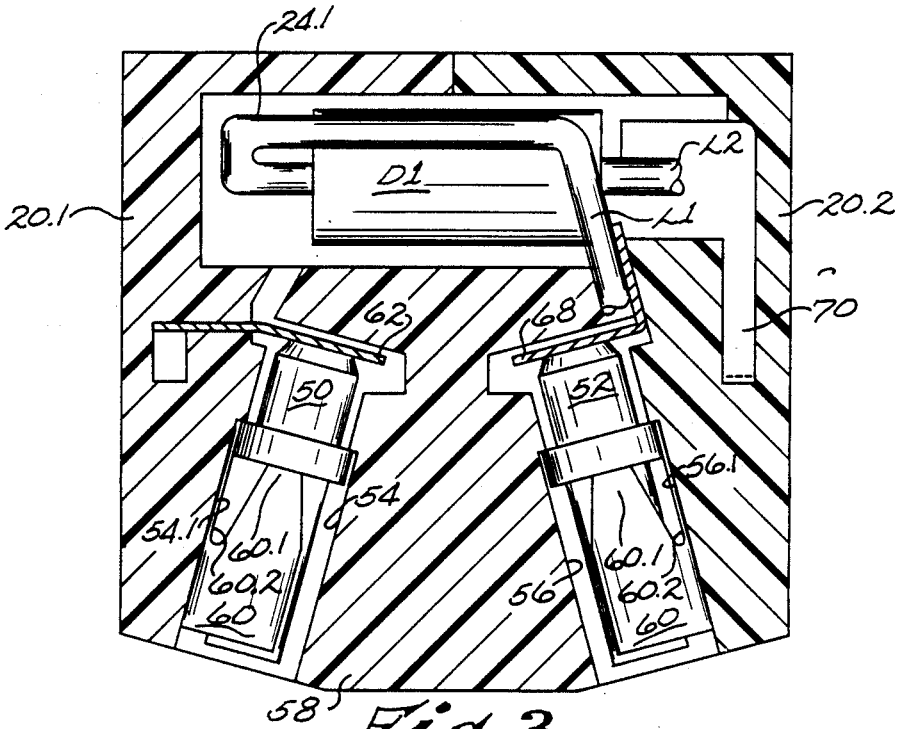
FIG. 3 is a cross sectional view through the auxiliary switch portion of the horsing containing the auxiliary switch components.

In accordance with the invention, casing halves 20 form an auxiliary switch chamber 24.1. As best seen in FIG. 3 first and second connecting pairs 50, 52 are received in respective wells 54, 56 formed between casing portions 20.1, 20.2 and a spacer member 58. Generally U-shaped clips 60 formed of suitable material such as a copper alloy have a pair of oppositely disposed legs 60.1 each having a distal end portion received under an annular flange formed in pins 50, 52 and a third leg 60.2 received in a cut out portion 54.1, 56.1 of wells 54, 56 respectively to lock the pins in their respective wells.

Pin 50 is in resilient engagement with a first contact spring 62 received in a slot formed in casing half 20.1 and is integrally attached to first terminal spring member 64 (see FIG. 5) formed of suitable material such as a copper alloy. Member 64 is an elongated member extending along the wall of casing 20 into chamber 24 adjacent operating member 28. The distal free end of terminal spring member 64 is formed with an inverted V-shape 66 aligned with one end portion of shaft 38 and adapted to contact the shaft on both faces of the V.

Pin 52 is resiliently biased against second contact spring 68 disposed in casing half 20.2 and is attached in any conventional manner, as to welding, to a lead L1 of diode D1 whose other lead L2 is attached in a similar manner to an end of second terminal spring member 70, a generally L-shaped member mounted in casing talf 20.2 having an elongated leg with a distal free end formed with an inverted V-shape 72 aligned with the other end portion of shaft 38 and adapted to contact the shaft on both faces of the V.

The spring retainers 60 can be formed of beryllium copper, or other suited material, the contact spring members and terminal spring members are formed of any suitable electrically conductive material having good spring characteristics such as a silver plated beryllium copper alloy while shaft 38 is preferably a stainless steel material plated with a gold layer.

Figure 4:
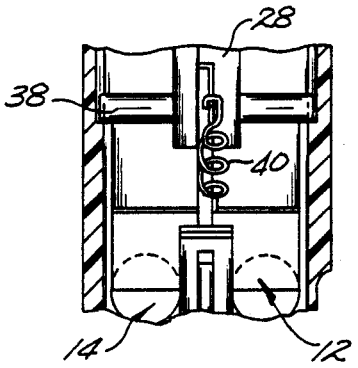
FIG. 4 is a broken away cross sectional view of the housing showing the lower portion of the operating member or plunger and a portion of the movable contact assembly.
Figure 5:
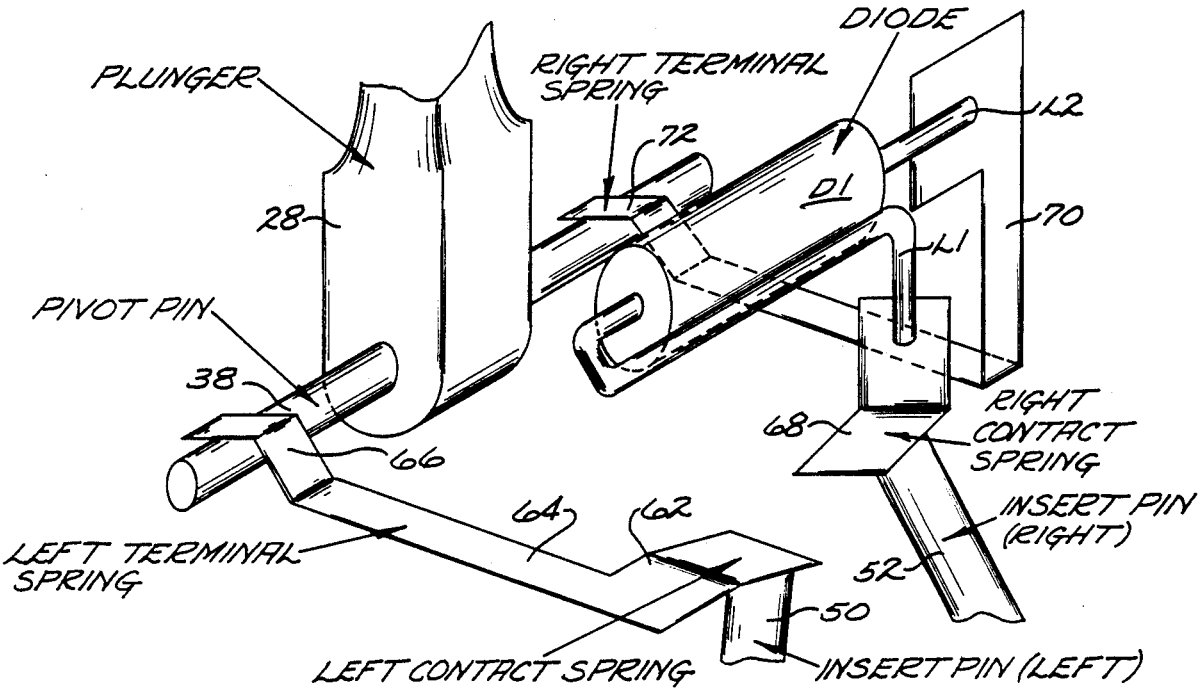
FIG. 5 is a schematic view of the auxiliary switch components.

Shaft 38, as seen in FIG. 4 extends outwardly beyond operating member 28 and as received in grooves formed in the casing halves and is movable between the lower, breaker contacts closed position shown in FIG. 1 shown in a solid line, and an upper, breaker contacts open position shown in a dashed line. When the operating member is in the upper position shaft 28 is in engagement with the V-shaped portions 66 and 72 forming a bridging electrical connection therebetween as seen in FIG. 5 to close the auxiliary switch circuit. When the operating member moves downwardly to the lower position shown in FIG. 1 shaft 38 moves cut of engagement with the portions 66 and 72 thereby opening the auxiliary switch circuit. Diode D1 is provided to characterize the direction of current flow in the auxiliary switch circuit.

It will therefore be seen that whenever the circuit breaker is open the auxiliary switch will be closed and whenever the circuit breaker is closed the auxiliary switch will be open to thereby provide a means for indicating the status of the circuit breaker through pins 50, 52 which are connectable to suitable indicating means such as a light emitting means. Further, it is within the purview of the invention to include a third pin in order to bypass the diode and therefore would provide the option of including the diode in the auxiliary circuit by inserting the pins 50, 52 in the proper bores 54, 56, or excluding the diode from the auxiliary circuit by inserting pin 50 and the third pin in respective locations 54 and a new bore (not shown). The third pin would be provided with a contact spring similar to 68 that will be directly connected to terminal spring member 70.

It should be understood that although a particular embodiment of the circuit breaker has been described by way of illustrating the invention, this invention includes all modifications and equivalents of the disclosed embodiments falling within the scope of the appended claims. For example the auxiliary switch could be configured to close when the circuit breaker contacts are closed and to open when the circuit breaker contacts open if so desired. Further there may be applications in which the diode is not required.

We claim:

1. A switching device comprising an electrically insulative base, a first contact means mounted on the base, manual actuating means mounted on the base for movement between first and second switch positions, means biasing the actuating means to the first switch position, and electrically conductive shaft rotatably mounting a first latch on the actuating means for movement therewith between the first and second switch positions, second contact means carried by the first latch, a catch movably mounted on the base to normally engage the first latch during movement of the actuating means into the second switch position for rotating the first latch to engage the second contact means with the first contact means, a second latch holding the actuator means in the second position when the first latch is engaged with the catch, the second latch being releasable by manual movement of the actuating means for permitting the actuating means to move to the first switch position to disengage the first and second contact means, and current responsive means mounted for movement on the base to move the catch out of engagement with the first latch for permitting the actuating means to move to the first switch position to disengage the first and second contact means, first and second electrically conductive, resilient terminal spring members mounted in spaced apart relation on the base, the members each having a free distal end portion located such that the distal end portions engage spaced portions of the electrically conductive shaft when the actuating means is in the first switch position, and first and second auxiliary terminal connecting pins mounted on the base in physical and electrical engagement with the respective first and second terminal spring members whereby a continuous electrical path extends from one auxiliary terminal connecting pin through a terminal spring member, the electrically conductive shaft, the other terminal spring member and the other auxiliary terminal connecting pin when the actuating means is in the first, contacts disengaged position.

2. A switching device according to claim 1 in which one of the first and second seeing members is formed in two spaced segments and a diode is connected therebetween.

3. A switching device according to claim 1 in which the distal end portions of the spring members are formed into a generally V-shaped configuration with the electrically conductive shaft being engageable with the two sides of the V-shaped configurations.

4. A switching device according to claim 1 in which the shaft has a coating of highly electrically conductive material.

5. A switching device according to claim 4 in which the coating material is gold.

* * * * *